US009204743B2

(12) United States Patent
Sirota et al.

(10) Patent No.: US 9,204,743 B2
(45) **Date of Patent: *Dec. 8, 2015**

(54) REVERSIBLE FOOD PLATE HAVING A SLOPE AND METHOD OF MAKING SAME

(71) Applicants: Seth Sirota, St. James, NY (US); Michele Sirota, St. James, NY (US)

(72) Inventors: Seth Sirota, St. James, NY (US); Michele Sirota, St. James, NY (US)

( * ) Notice: Subject to any disclaimer, the term of this patent is extended or adjusted under 35 U.S.C. 154(b) by 7 days.

This patent is subject to a terminal disclaimer.

(21) Appl. No.: 14/052,757

(22) Filed: Oct. 13, 2013

(65) Prior Publication Data

US 2014/0034652 A1 Feb. 6, 2014

Related U.S. Application Data

(60) Continuation-in-part of application No. 13/918,982, filed on Jun. 16, 2013, now Pat. No. 8,844,752, which is a division of application No. 12/701,510, filed on Feb. 5, 2010, now Pat. No. 8,490,823.

(51) Int. Cl.
*A47G 19/02* (2006.01)
*A47G 19/08* (2006.01)

(52) U.S. Cl.
CPC ..... *A47G 19/02* (2013.01); *A47G 19/08* (2013.01)

(58) Field of Classification Search
CPC ..... A47G 19/02; A47G 19/08
USPC ..... 220/574, 574.1, 575, 628, 632, 636; 264/239, 250
See application file for complete search history.

(56) References Cited

U.S. PATENT DOCUMENTS

| | | | |
|---|---|---|---|
| 766,427 | A | 8/1904 | Crowell |
| 876,808 | A | 1/1908 | Kinert |
| 1,272,996 | A | 7/1918 | Poschadel |
| D52,278 | S | 8/1918 | Kraus |
| 1,379,519 | A | 5/1921 | Bjornsen |
| 1,488,462 | A | 4/1924 | Edmund |
| 1,520,402 | A | 12/1924 | Clemans |
| 2,170,311 | A | 8/1939 | Smith |
| 2,207,417 | A | 7/1940 | Smith |
| D162,013 | S | 2/1951 | Day |
| 2,561,594 | A | 7/1951 | Pokras |
| D168,283 | S | 12/1952 | Adams |
| 2,655,016 | A | 10/1953 | Hudson |
| 2,672,697 | A | 3/1954 | La Tour |
| 2,843,287 | A | 7/1958 | Finley |
| 3,014,616 | A | 12/1961 | Kavanaugh |
| 3,611,998 | A | 10/1971 | Loscalzo |

(Continued)

*Primary Examiner* — Fenn Mathew
*Assistant Examiner* — Elizabeth Volz
(74) *Attorney, Agent, or Firm* — Carol Larcher; Larcher & Chao Law Group

(57) ABSTRACT

A reversible food plate, which is molded from plastic, such as polypropylene, and comprises a first surface and a second surface, each of which has a slope, and an edge, wherein the bottom of the slope of the first surface is on the opposite end of the plate from the bottom of the slope of the second surface, wherein the edge forms a first rim and a second rim, which together form a side wall, which is over-molded with a thermoplastic elastomer (TPE) and has an external surface, which is perpendicular to a flat or substantially flat surface on which the plate is placed, wherein, when pressure is applied to an upwardly facing surface of a plate resting on a flat or substantially flat surface, suction is created between the side wall of the food plate and the surface; and a method of making the reversible food plate comprising molding the food plate from plastic, such as polypropylene, and over-molding the side wall with TPE.

21 Claims, 9 Drawing Sheets

(56) References Cited

U.S. PATENT DOCUMENTS

| | | | | |
|---|---|---|---|---|
| D238,739 | S | 2/1976 | Thomas | |
| D244,338 | S | 5/1977 | Yauger | |
| 4,351,444 | A | 9/1982 | Majewski | |
| D283,096 | S | 3/1986 | Uhrik | |
| D305,846 | S | 2/1990 | Griffith | |
| 4,986,434 | A | 1/1991 | Prestyly, Jr. | |
| 5,172,826 | A | 12/1992 | Celaya | |
| 5,341,953 | A | 8/1994 | Forester | |
| 5,390,816 | A | 2/1995 | Boyd | |
| D367,587 | S | 3/1996 | Perlmutter et al. | |
| 5,542,565 | A | 8/1996 | Hidalgo-Lopez | |
| 5,638,981 | A | 6/1997 | Crane et al. | |
| 5,676,275 | A | 10/1997 | Khattar | |
| D390,419 | S | 2/1998 | Perlmutter et al. | |
| D396,778 | S | 8/1998 | Asphar | |
| D433,283 | S | 11/2000 | Thomas | |
| D434,276 | S | 11/2000 | Obra | |
| D473,758 | S | 4/2003 | Wilson | |
| D481,594 | S | 11/2003 | Roehrig | |
| 7,637,388 | B2 | 12/2009 | Schantz et al. | |
| 8,490,823 | B2 * | 7/2013 | Sirota et al. | 220/574.1 |
| 2007/0039966 | A1 | 2/2007 | Schantz et al. | |
| 2007/0091718 | A1 * | 4/2007 | Browne et al. | 366/347 |
| 2010/0096391 | A1 | 4/2010 | Schantz et al. | |

* cited by examiner

REVERSIBLE FOOD PLATE HAVING A SLOPE AND METHOD OF MAKING SAME

CROSS REFERENCE TO RELATED APPLICATIONS

This application is a Continuation-in-Part of U.S. patent application Ser. No. 13/918,982, filed Jun. 16, 2013, which is a Divisional of U.S. patent application Ser. No. 12/701,510, filed Feb. 5, 2010, and now U.S. Pat. No. 8,490,823 B2, issued Jul. 23, 2013, the contents of all of which are incorporated herein by reference in their entireties.

TECHNICAL FIELD

The present disclosure relates to a food plate and method of making same.

BACKGROUND

A food plate provides a food-bearing surface for serving and eating food. It is common for meat, vegetables, and either potatoes or rice to be placed on the same plate. Depending on how the meat, vegetables, and potatoes/rice are prepared, it is not unusual for liquid, such as water, butter or sauce, from the vegetables to come in contact with the other food on the plate. Likewise, toppings on potatoes/rice, such as gravy, sauce, butter and/or sour cream, can contact the other food on the plate. Natural juices and fat/grease from meat, as well as sauce or gravy, as the case may be, also can contact other food on the plate. While some individuals are not bothered by this and, perhaps, even prefer it, other individuals do not like one food item to come in contact with another item, whether it is due to the impact of such contact on flavor, an underlying obsessive-compulsive disorder, special needs, a dietary restriction, or other reason. Divided plates have been proposed to keep food items on a plate separate from each other. However, divided plates are disadvantageous in that it can be difficult for certain people to eat off a divided plate. Furthermore, divided plates do not eliminate the problem of vegetables sitting in liquid, such as water, and meat sitting in fat/grease. Scooper plates and plate guards have been proposed to aid (i) individuals with physical disabilities, such as those with hand tremors (e.g., individuals with Parkinson's disease), uncontrolled movement of the hands, restricted movement of the hands (e.g., individuals with arthritis or partial paralysis or recovering from stroke), injuries, and birth defects, (ii) children, who are learning to eat, and (iii) individuals with various types of mental/learning disabilities, to eat off of plates by providing a plate with a graduated side wall that is shallow on one side and deep on the other (see, e.g., Freedom Dinnerware Scooper Plate, which is available from www.arthritissupplies.com) or a truncated side wall (see, e.g., plate guards available from Arthritis Supplies's website and My Plate-Mate™, which is available from www.myplate-mate.com). Scooper plates, which come in flat and divided versions, and plate guards, however, still do not address the problem of vegetables sitting in liquid, such as water, and meat sitting in fat/grease.

In addition to the above, it is also common for a food item to be placed on the same plate with a topping, such as a sauce or a syrup, or condiment, such as ketchup, with which it is intended to be eaten. Unfortunately, many such food items become soggy when left in contact with such a topping, even for the length of time it takes to eat the food item. Sometimes, the food item becomes unpalatable as a result, either due to texture and/or flavor (e.g., becoming too sweet). Keeping the liquid topping in a separate container (e.g., a small bowl or a condiment cup) has been proposed to address this problem. However, when the separate container is kept on the plate, it can interfere with eating off the plate, and, when the separate container is kept beside the plate, drips between the container and the plate often result as do spills, thereby creating a mess to clean up. Divided plates also have been proposed to address this problem. However, as noted above, it can be difficult for certain people to eat off a divided plate.

In view of the above, there remains a need for a food plate that (i) is easy for a person, including a person with a disability, to eat off, (ii) minimizes, and preferably eliminates, vegetables sitting in liquid and meat sitting in fat/grease, and (iii) keeps a food item and a liquid topping separate in a way that does not interfere with eating off the food plate and minimizes, and preferably eliminates, messiness. It is an object of the present disclosure to provide such a food plate. This and other objects and advantages, as well as inventive features, will become apparent from the detailed description provided herein.

SUMMARY

A reversible food plate is provided. The reversible food plate comprises a first surface and a second surface, each of which has a slope, and an edge. The slope of the first surface optionally comprises at least one depression at the bottom of the slope and adjacent to the edge. At least each portion of the edge that is adjacent to the bottom of the slope forms a first rim, or substantially all or all of the edge forms a first rim. At least each portion of the first rim that is adjacent to the bottom of the slope is pronounced or more pronounced than a portion of the first rim that is not adjacent to the bottom of the slope. The slope of the second surface optionally comprises at least one depression at the bottom of the slope and adjacent to the edge. At least each portion of the edge that is adjacent to the bottom of the slope forms a second rim, or substantially all or all of the edge forms a second rim. At least each portion of the second rim that is adjacent to the bottom of the slope is pronounced or more pronounced than a portion of the second rim that is not adjacent to the bottom of the slope. The bottom of the slope of the first surface is on the opposite end of the plate from the bottom of the slope of the second surface. The first rim and the second rim form a side wall having an external surface. When the first rim of the first surface or the second rim of the second surface is placed on a flat or substantially flat surface, the external surface of the side wall is perpendicular to the flat or substantially flat surface. The food plate is molded from plastic, such as a flexible plastic, in which case, when the food plate is placed on a flat or substantially flat surface with either the first surface or the second surface facing upwardly and pressure is applied on the upwardly facing surface, suction is created between the side wall of the food plate and the flat or substantially flat surface. The plastic can be a thermoplastic polymer, such as polypropylene. The side wall is over-molded, such as over-molded with a thermoplastic elastomer (TPE). The slope of the first surface, the slope of the second surface, or the slope of the first surface and the slope of the second surface can comprise one depression. The food plate can be stackable, such as when the first rim is tapered slightly at the edge so that it fits inside the second rim of a reversible food plate stacked on top of it or when the second rim is tapered slightly at the edge so that it fits inside the first rim of a reversible food plate stacked on top of it. The food plate can further comprise at least one removable lid to which is optionally removably attached one or more eating utensils. The food plate can comprise a surface wall, which, together with the side wall of the plate, can enclose an area at the base of the slope. If the slope comprises a depression, the surface wall, together with the side wall of the plate, can enclose the depression. The food plate can further comprise a flat region at the top of the slope, at the bottom of the slope, or at the top of the slope and at the bottom of the slope of the first surface and/or a flat region at the top of the slope, at the bottom of the slope, or at the top of the slope and at the bottom of the slope of the second surface.

A method of making a reversible food plate is also provided. The method comprises (i) molding from plastic a food plate as described above, and (ii) simultaneously or subsequently over-molding the side wall, such as over-molding the side wall with a TPE. The plastic can be a flexible plastic, in which case, when the food plate is placed on a flat or substantially flat surface with either the first surface or the second surface facing upwardly and pressure is applied on the upwardly facing surface, suction is created between the side wall of the food plate and the flat or substantially flat surface. The plastic can be a thermoplastic polymer, such as polypropylene. The first rim of the plate can be tapered slightly at the edge so that it fits inside the second rim of a reversible food plate stacked on top of it. Alternatively, the second rim of the plate can be tapered slightly at the edge so that it fits inside the first rim of a reversible food plate stacked on top of it. The first surface, the second surface, or the first surface and the second surface can further comprise a surface wall, which, together with the side wall of the plate, can enclose an area at the base of the slope. When the slope of the first surface, the slope of the second surface, or the slope of the first surface and the slope of the second surface comprise(s) a depression, the surface wall, together with the side wall of the plate, can enclose the depression. The first surface, the second surface, or the first surface and the second surface further comprise(s) a flat region at the top of the slope, a flat region at the bottom of the slope, or a flat region at the top of the slope and a flat region at the bottom of the slope.

DETAILED DESCRIPTION

A food plate comprising a first surface having a slope, a second surface, and an edge is provided. At least the first surface has a slope. Desirably, the degree of the slope is sufficient to allow a liquid to move down the slope. Preferably, the degree of the slope is sufficient to allow a viscous liquid, such as syrup, to move down the slope. The degree of the slope should not be so great as to make eating off the food plate difficult. Preferably, the slope is less than about 15°, such as about 2.5°, about 5°, about 7.5°, about 10°, or about 12.5°. The slope of the first surface optionally comprises at least one depression, and preferably comprises one depression, at the bottom of the slope and adjacent to the edge. For ease of reference, the term "adjacent" is used herein to encompass adjacent, adjoining, and contiguous. The overall dimensions of the depression are not critical. Preferably, the depression is large enough to contain at least a single serving of a liquid, such as syrup, or a condiment, such as ketchup. At least each portion of the edge that is adjacent to the bottom of the slope (and, when present, the depression) forms a rim (a "first rim" on the first surface of the food plate and a "second rim" on the second surface of the food plate) or substantially all or all of the edge forms a rim (first rim or second rim) and at least each portion of the rim (first rim or second rim) that is adjacent to the bottom of the slope (and, when present, the depression) is pronounced or more pronounced than a portion of the rim (first rim or second rim) that is not adjacent to the bottom of the slope. For ease of reference, the term "pronounced" is used herein to encompass taller (see, by way of example, the graduated rim (54) on the left as compared to the graduated rim (54) on the right in FIG. 6), as well as wider, thicker, curved, or more curved, and the like. Preferably, the pronounced portion is taller.

Figure 1:
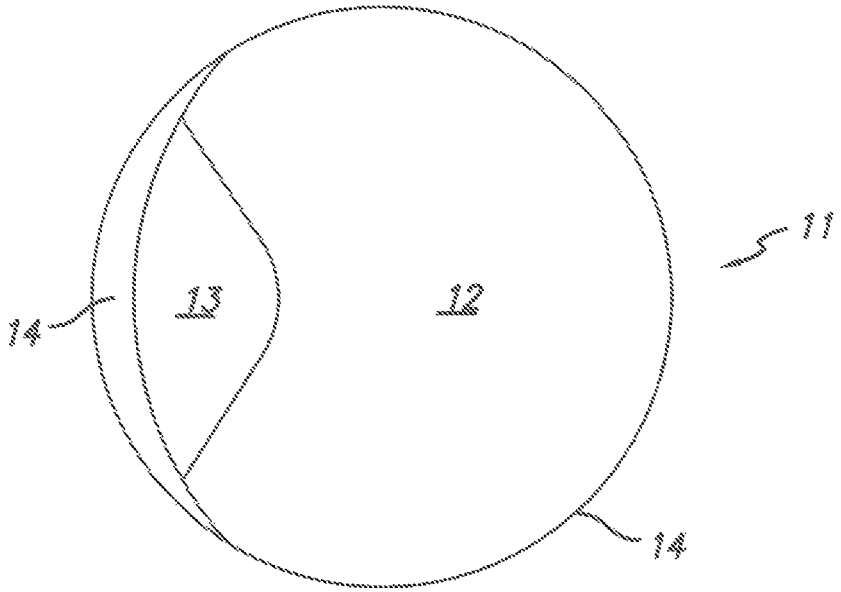
FIG. 1 is a top view of a food plate (11) comprising a first surface (12) having a slope comprising a depression (13). The edge of the food plate forms a first rim (14), which is shown optionally curved adjacent to the bottom of the slope.

FIG. 1 is a top view of a food plate (11) comprising a first surface (12) having a slope comprising a depression (13). The edge of the food plate forms a first rim (14), which is shown optionally curved adjacent to the bottom of the slope.

The second surface of the food plate can be substantially flat or flat. When the second surface of the food plate is substantially flat or flat, optionally the second surface is slip-resistant. The second surface, itself, can be textured, which in and of itself renders the surface slip-resistant. Alternatively, the second surface can comprise a suction pad or the like, which can be attached to a flat surface, such as a table, a tray, or a placemat. Alternatively, a tray or a placement can comprise clips or the like that can hold the food plate in place. In the absence of a suction pad or the like, the second surface of the food plate can function as a second food-bearing surface. In other words, the food plate can be reversed, such that the first surface (12) having a slope comprising a depression (13) can be used before or after the second surface, which is substantially flat or flat.

Figure 3:
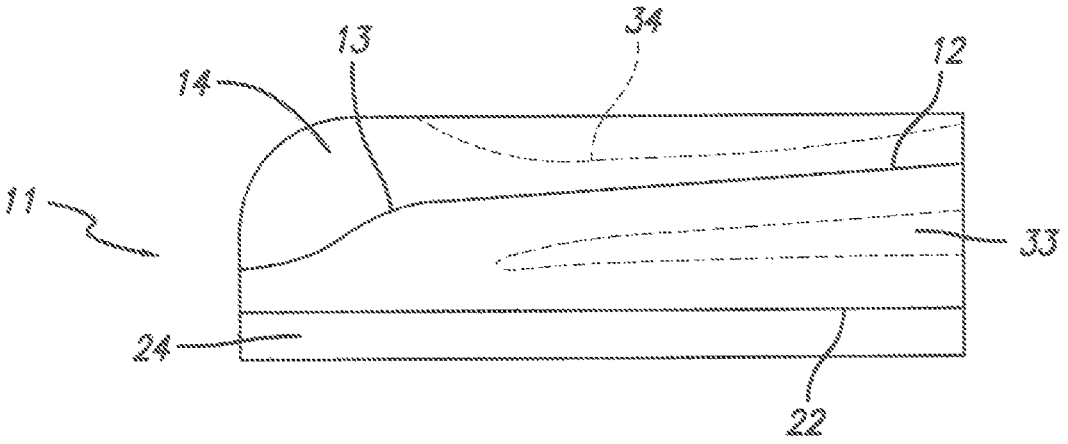
FIG. 3 is a cross-sectional view of a food plate (11) comprising a first surface (12) having a slope comprising a depression (13) and a second surface (22), which is flat. The first rim (14) is pronounced or more pronounced, i.e., taller, adjacent to the bottom of the slope, and is shown optionally curved adjacent to the bottom of the slope. The second rim (24) is shown uniform but need not be. The dotted area (33) represents a hollow area that is optionally present within the plate. The dotted line (34) shows an alternate edge of the first rim (14).

FIG. 3 is a cross-sectional view of a food plate (11) comprising a first surface (12) having a slope comprising a depression (13) and a second surface (22), which is flat. The first rim (14) is pronounced or more pronounced, i.e., taller, adjacent to the bottom of the slope, and is shown optionally curved adjacent to the bottom of the slope. The second rim (24) is shown uniform but need not be. The dotted area (33) represents a hollow area that is optionally present within the plate. The dotted line (34) shows an alternate edge of the first rim (14). Food can be placed on the first surface or the second surface. When food is to be placed on the second surface, the first rim of the first surface can be stably placed on a flat or substantially flat surface with the outer edge or edges of the first rim substantially parallel or parallel to the flat or substantially flat surface.

Another food plate comprising a first surface having a slope, a second surface having a slope, and an edge is also provided. Each of the first surface and the second surface optionally comprises at least one depression, and preferably comprises one depression, at the bottom of the slope and adjacent to the edge of the plate. Preferably, the depression on the first surface is on the opposite side of the plate from the depression on the second surface. At least each portion of the edge that is adjacent to the bottom of the slope (and, when present, the depression) on the first surface forms a first rim or substantially all or all of the edge forms a first rim and at least each portion of the first rim that is adjacent to the bottom of the slope (and, when present, the depression) is pronounced or more pronounced than a portion of the first rim that is not adjacent to the bottom of the slope. At least each portion of the edge that is adjacent to the bottom of the slope (and, when present, the depression) on the second surface forms a second rim or substantially all or all of the edge forms a second rim and at least each portion of the second rim that is adjacent to the bottom of the slope (and, when present, the depression) is pronounced or more pronounced than a portion of the second rim that is not adjacent to the bottom of the slope. The bottom edge (i.e., the edge that is not the outer edge or edges) of the first rim and the bottom edge (i.e., the edge that is not the outer edge or edges) of the second rim can be separated from or adjoined to each other. Either (i) the first rim of the first surface can be stably placed on a flat or substantially flat surface with the outer edge or edges of the first rim substantially parallel or parallel to the flat or substantially flat surface or (ii) the second rim of the second surface can be stably placed on a flat or substantially flat surface with the outer edge or edges of the second rim substantially parallel or parallel to the flat or substantially flat surface.

Figure 2:
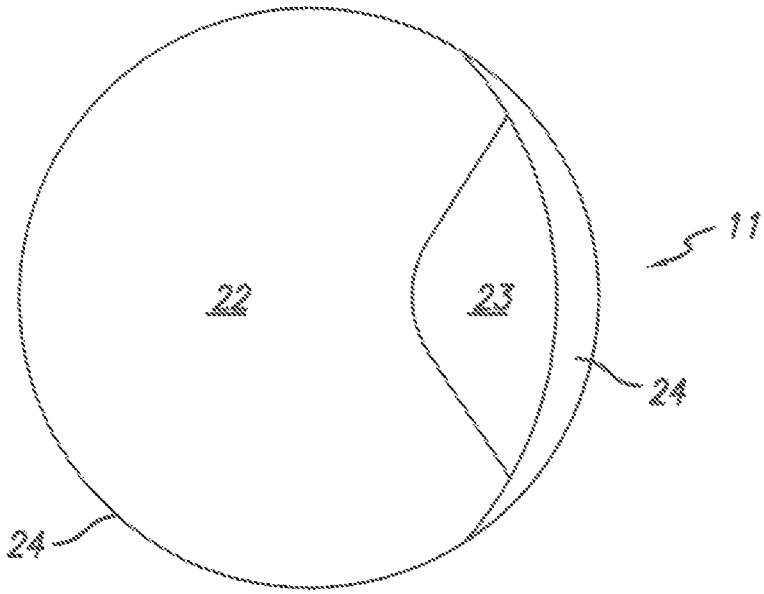
FIG. 2 is a bottom view of a food plate (11) comprising a second surface (22) having a slope comprising a depression (23). The edge of the food plate forms a second rim (24), which is shown optionally curved adjacent to the bottom of the slope.
Figure 4:
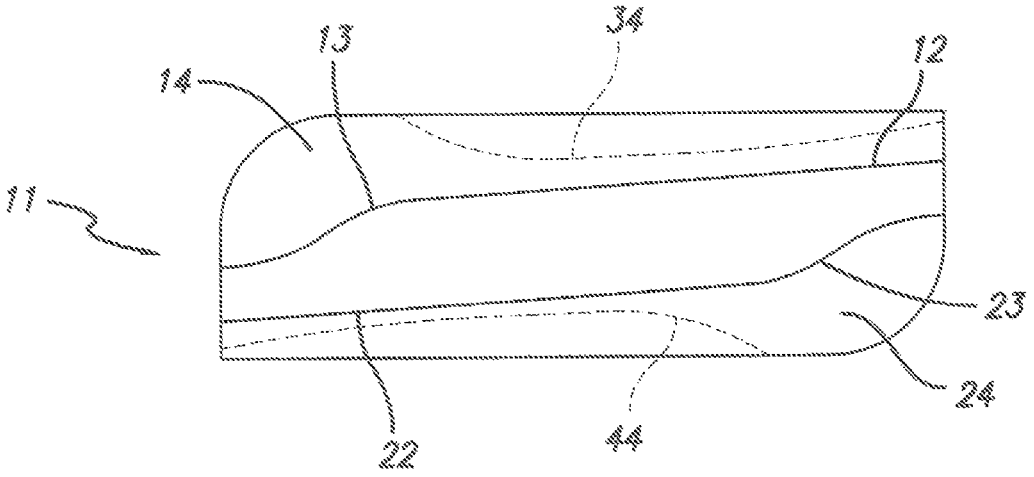
FIG. 4 is a cross-sectional view of a food plate (11) comprising a first surface (12) having a slope comprising a depression (13) and a second surface (22) having a slope comprising a depression (23). The depression (13) on the first surface (12) is on the opposite side of the plate from the depression (23) on the second surface (22). The dotted line (34) shows an alternate edge of the first rim (14), whereas the dotted line (44) shows an alternate edge of the second rim (24).

FIG. 4 a cross-sectional view of a food plate (11) comprising a first surface (12) having a slope comprising a depression (13) (as shown in FIG. 1) and a second surface (22) having a slope comprising a depression (23) (as shown in FIG. 2, which is a bottom view of a food plate (11) comprising (i) a second surface (22) having a slope comprising a depression (23) and (ii) a second rim (24), which is shown optionally curved adjacent to the bottom of the slope). The depression (13) on the first surface is on the opposite side of the plate from the depression (23) on the second surface. In this cross-sectional view of a food plate, the first rim (14) and the second rim (24) are shown optionally curved in the region of the bottom of the slope. The dotted line (34) shows an alternate edge of the first rim, whereas the dotted line (44) shows an alternate edge of the second rim (24). The first rim and the second rim can comprise alternate edges, which can be the same or different.

Food can be placed on the first surface or the second surface. When food is to be placed on the second surface, the first rim of the first surface can be stably placed on a flat or substantially flat surface with the outer edge or edges of the first rim substantially parallel or parallel to the flat or substantially flat surface.

Figure 9:
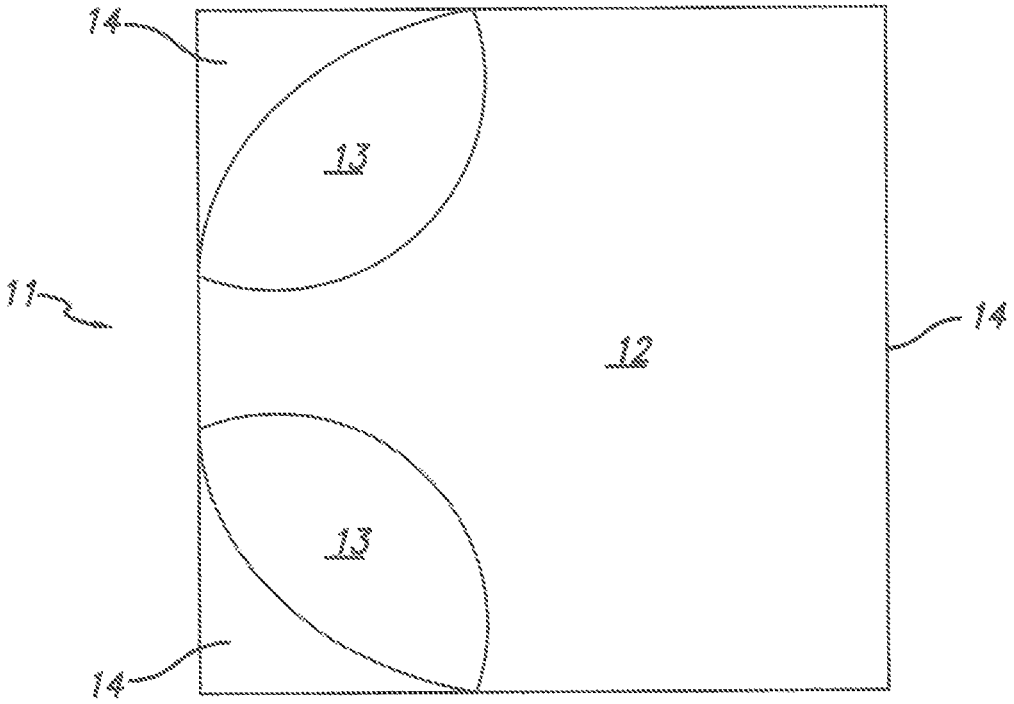
FIG. 9 is a top view of a food plate (11) comprising a first surface (12) having a slope comprising two depressions (13). The edge of the food plate forms a first rim (14), which is shown optionally curved adjacent to the depressions at the bottom of the slope.

A food plate as described above can comprise a first surface, a second surface, or a first surface and a second surface having a slope comprising two (or more) depressions. FIG. 9 is a top view of a food plate (11) comprising a first surface (12) having a slope comprising two depressions (13). The edge of the food plate forms a first rim (14), which is shown optionally curved adjacent to the depressions at the bottom of the slope. The second surface of the food plate can be flat or substantially flat. Alternatively, the second surface of the food plate can have a slope comprising one or two (or more) depressions. If the first surface has a slope comprising two (or more) depressions and the second surface has a slope comprising one or two (or more) depressions, preferably, the depressions on the first surface are on the opposite end of the plate from the depression(s) on the second surface.

If desired, an above-described food plate, such as an above-described food plate having a least one surface having a slope, which can comprise a depression, can further comprise a surface wall. The surface wall, such as together with the side wall of the plate, can enclose an area (or define the perimeter of an area) at the base of the slope. If the slope comprises a depression, the surface wall, such as together with the side wall of the plate, can enclose the depression (e.g., the perimeter of the depression). The shape of the wall can be any suitable shape, such as semi-circular (or arced) or pie-shaped (i.e., two walls of a triangle). The height of the surface wall can be any suitable height. The surface wall can have a height about the same as, or the same as, that of the side wall of the plate. The surface wall can vary in height along its length. For example, the surface wall can be taller adjacent to the side wall of the plate, in which case the surface wall is about as tall or as tall as the side wall of the plate. Preferably, and even desirably, the surface wall is not taller than the side wall of the plate at the base of the slope and is slightly shorter than the side wall of the plate at the base of the slope. The width of the surface wall can be any suitable width. The surface wall can have a width about the same as, or the same as, the thickness of the plate, itself. Preferably, and even desirably, the width of the surface wall is less than the thickness of the plate, itself, such as about 0.90, 0.80, or 0.70 times, that of the thickness of the plate.

Figure 14:
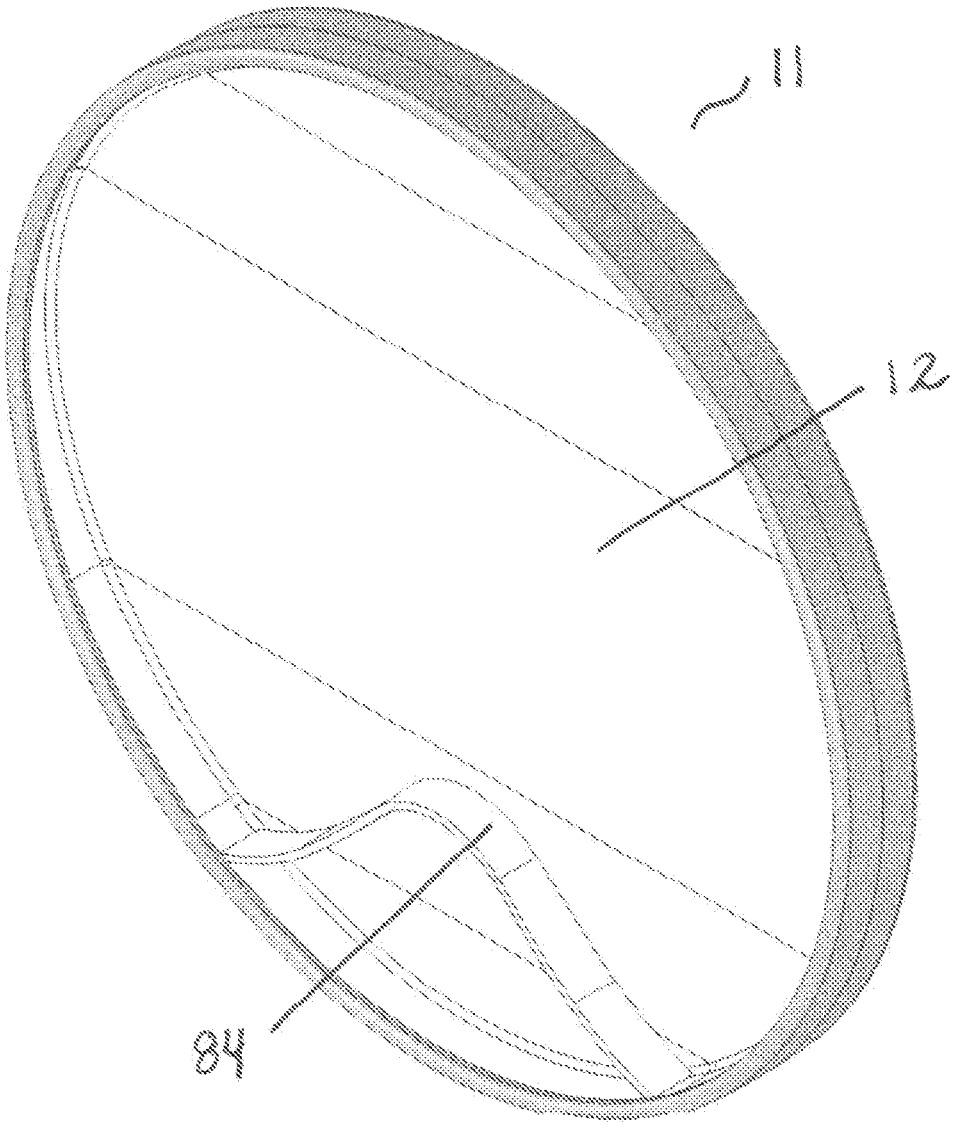
FIG. 14 is a view of a food plate (11) comprising a first surface (12) having a slope, at the base of which is a surface wall (84).
Figure 15:
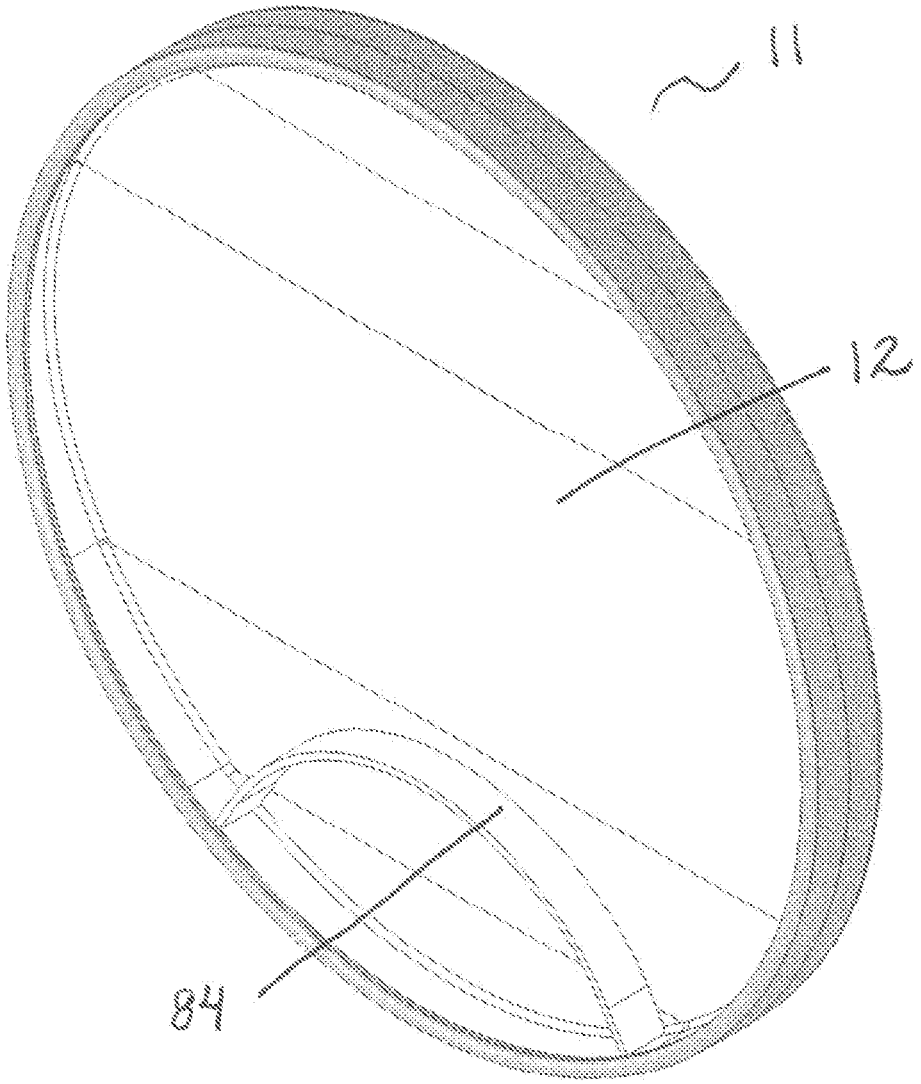
FIG. 15 is a view of a food plate (11) comprising a first surface (12) having a slope, at the base of which is a surface wall (84).

FIG. 14 is a view of a food plate (11) comprising a first surface (12) having a slope, at the base of which is a surface wall (84) that is semi-circular or arced. FIG. 15 is a view of a food plate (11) comprising a first surface (12) having a slope, at the base of which is a surface wall (84) that is more pie-shaped.

The food plates can be stackable. Preferably, stackable food plates form stable stacks and do not easily topple over. In this regard, the first rim of the plate can be tapered slightly at the edge so that it fits inside the second rim of a reversible food plate stacked on top of it. Alternatively, the second rim of the plate can be tapered slightly at the edge so that it fits inside the first rim of a reversible food plate stacked on top of it.

The food plate can further comprise a removable lid. The lid can be used to microwave food on the food plate and to store food on the food plate, such as in a refrigerator, a freezer, or a lunch container, and the like. When one side of the food plate has been used and the other side of the food plates is going to be used next, a removable lid can be placed on the previously used side prior to turning the plate over. The removable lid then helps to keep leftover food and/or liquid on the previously used side from making a mess on a flat surface, for example, on which the food plate is placed.

Optionally, one or more eating utensils, such as a fork, a knife, a spoon, a spork, a napkin, and/or an individually wrapped wet wipe, can be removably attached to the removable lid. The eating utensils can be colored, numbered, and/or decorated in a way to distinguish utensils belonging with one food plate (or the user of the food plate) from utensils belonging with another food plate.

Preferably, the food plate is resistant to breaking. More preferably, the food plate is unbreakable under normal use. Also preferably, the food plate is dishwasher and/or microwave safe.

The food plate can be made from any suitable material as is known in the art in accordance with methods known in the art. Preferably, the food plate is plastic, such as a rigid plastic or a flexible plastic. Preferred materials include thermoplastic polymers, such as polycarbonate and polypropylene, in particular FDA-approved polypropylene. Co-polymerization of a thermoplastic polymer, such as polypropylene, with ethylene can increase the flexibility of the plastic. Preferably, the material is BPA-free, phthalate-free (although polyethylene terephthalate (PET) is used for various containers), and PVC-free. Other materials include polystyrene, melamine, paper, Styrofoam, glass, clay, metal, and the like. The food plate can vary in size and/or shape. Typically, a food plate is flat and round with a diameter from about 6 inches to about 12 inches, such as about 6 inches, about 6½ inches, about 7 inches, about 7½ inches, about 8 inches, about 8½ inches, about 9 inches, about 9½ inches, or about 10 inches. The food plate can be colored, numbered, and/or decorated in a way to distinguish one food plate from another food plate (e.g., pink for girl, blue for boy).

In view of the above, a reversible food plate, which comprises a first surface and a second surface, each of which has a slope, and an edge is provided. The slope of the first surface optionally comprises at least one depression at the bottom of the slope and adjacent to the edge. At least each portion of the edge that is adjacent to the bottom of the slope forms a first rim, or substantially all or all of the edge forms a first rim and at least each portion of the first rim that is adjacent to the bottom of the slope is pronounced or more pronounced than a portion of the first rim that is not adjacent to the bottom of the slope. The slope of the second surface optionally comprises at least one depression at the bottom of the slope and adjacent to the edge. At least each portion of the edge that is adjacent to the bottom of the slope forms a second rim, or substantially all or all of the edge forms a second rim and at least each portion of the second rim that is adjacent to the bottom of the slope is pronounced or more pronounced than a portion of the second rim that is not adjacent to the bottom of the slope. The bottom of the slope of the first surface is on the opposite end of the plate from the bottom of the slope of the second surface. The first rim and the second rim form a side wall having an external surface. When the first rim of the first surface or the second rim of the second surface is placed on a flat or substantially flat surface, the external surface of the side wall is perpendicular to the flat or substantially flat surface. Preferably, the food plate is molded from plastic, such as a flexible plastic, in which case, when the food plate is placed on a flat or substantially flat surface with either the first surface or the second surface facing upwardly and pressure is applied on the upwardly facing surface, suction is created between the side wall of the food plate and the flat or substantially flat surface. Preferably, the suction can be created by applying pressure anywhere on the upwardly facing surface of the plate; however, preferably, and even desirably, the strongest suction can be created by applying pressure on the center of the upwardly facing surface of the plate. Application of more pressure preferably, and even desirably, increases the strength of the suction. The suction can be released in any suitable manner, such as by re-applying pressure and lifting up on the side wall of the plate. The plastic can be a thermoplastic polymer, such as polypropylene. The side wall can be over-molded, such as over-molded with a thermoplastic elastomer (TPE). The slope of the first surface, the slope of the second surface, or the slope of the first surface and the slope of the second surface can comprise one depression. The plate can be stackable, in which case, the first rim can be tapered slightly at the edge so that it fits inside the second rim of a reversible food plate stacked on top of it or the second rim can be tapered slightly at the edge so that it fits inside the first rim of a reversible food plate stacked on top of it. The plate can further comprise at least one removable lid to which is optionally removably attached one or more eating utensils. The plate can further comprise a surface wall, which, together with the side wall of the plate, can enclose an area at the base of the slope. If the slope comprises a depression, the surface wall, together with the side wall of the plate, can enclose the depression. The food plate can comprise a flat region at the top of the slope, at the bottom of the slope, or at the top of the slope and at the bottom of the slope of the first surface and/or a flat region at the top of the slope, at the bottom of the slope, or at the top of the slope and at the bottom of the slope of the second surface.

Also provided is a method of making a food plate. The method comprises forming a food plate comprising a first surface, a second surface, and an edge. At least the first surface has a slope, which optionally comprises at least one depression, and preferably comprises one depression, at the bottom of the slope and adjacent to the edge. In this regard, while the eating surface of the plate is preferably made from a rigid material, such as a rigid plastic material, the edge of the plate, such as an edge of the plate that forms a rim can be made from a flexible plastic. At least each portion of the edge that is adjacent to the bottom of the slope on the first surface is formed into a first rim or substantially all or all of the edge is formed into a first rim and at least each portion of the first rim that is adjacent to the bottom of the slope on the first surface is pronounced or more pronounced than a portion of the first rim that is not adjacent to the bottom of the slope. The second surface also can have a slope, which optionally comprises at least one depression, and preferably comprises one depression, at the bottom of the slope and adjacent to the edge. At least each portion of the edge that is adjacent to the bottom of the slope on the second surface is formed into a second rim or substantially all or all of the edge is formed into a second rim and at least each portion of the second rim that is adjacent to the bottom of the slope on the second surface is pronounced or more pronounced than a portion of the second rim that is not adjacent to the bottom of the slope.

In a preferred embodiment, a food plate is molded (e.g., injection molding or compression molding) and, simultaneously or sequentially, over-molded. For example, a food plate can be molded from a plastic, such as a flexible plastic, for example, a thermoplastic polymer, e.g., polypropylene. The food plate then can be inserted into a tool and a TPE, for example, can be injected onto the plate in a process referred to as "insert molding". A bond between the plastic and the TPE is formed by mechanical, melt, and/or chemical means. In order to achieve a chemical or adhesive bond, the TPE must be sufficiently hot to melt the surface of the plastic. Alternatively, the TPE must activate the surface of the plastic to achieve a chemical bond. Stronger bonds can be achieved by preheating the insert (in this case, the food plate) before it is over-molded with the TPE. While the tool used for over-molding can be designed to address issues such as thermal expansion and shrinkage and, thus, is advantageous over other methods, disadvantages include generally weaker bonds, the need for two separate molding steps, and the need to inventory substrates.

Another method that can be used for over-molding is "two-shot molding," which requires two injection molding machines and a tool with several gates and activated slides. The plastic substrate is injection-molded first, and then the substrate is indexed to the TPE injection machine, where the TPE is injected onto the substrate. Since the substrate is hot, it is usually in a semi-solid, gel phase when it is indexed to the TPE injection machine, resulting in melt and chemical bonding that are generally better than that which can be achieved by insert molding over an unheated substrate (i.e., the insert). Another advantage of two-shot molding is that the molds can be designed with undercuts and overhangs in the plastic part to ensure that a stable mechanical bond is attained; however, excellent adhesion can be achieved by proper material selection, thereby obviating the need for undercuts and overhangs.

Yet another method that can be used for over-molding is "co-injection molding," during which the plastic for the substrate (i.e., the plate) and the TPE are simultaneously injected into the same tool and the TPE migrates to the outer layer. The degree of compatibility between the plastic of the substrate and the TPE is critical and must be carefully controlled. Since the plastic for the substrate and the TPE are completely in the melt state at the time that they are combined within the tool, co-injection molding can provide the greatest melt and chemical adhesion of the three over-molding methods. However, the cost of co-injection molding and the difficulty in controlling the process make this method the least used over-molding method.

Irrespective of which method is used, materials are usually chosen specifically to bond together, using the heat from the injection of the second material to form the bond. Material selection avoids the use of adhesives and assembly of the completed parts. It can result in a robust, multi-material part with a high quality finish. A preferred combination is the use of polypropylene to mold the plate and the use of Monprene® (Teknor Apex, Pawtucket, R.I.) as the TPE for the overmold.

In addition to material selection, preferably, and even desirably, the thickness of the plate (the insert in the insert molding method) and the over-mold should be as uniform as possible to ensure an even and robust bond. Ribs and sharp corners are preferably, and even desirably, avoided to reduce, if not eliminate, flow problems during molding. Furthermore, the cooling system should be optimized to help reduce the cycle time of cooling an over-molded product, which typically takes longer to cool than a corresponding product that is not over-molded.

Depending on the method of manufacture (e.g., molding, such as injection molding), it can be preferable, and even desirable, to introduce a small flat region at the top of the slope and/or a small flat region at the bottom of the slope on either or both surfaces of the plate in order to obtain a side wall of a preferred or desired height. A flat region at the top of a slope can have the same width as a flat region at the bottom of the slope; alternatively, a flat region at the top of a slope can differ in width from that of a flat region at the bottom of the slope. In addition, flat region(s) on one surface of the plate, such as the first surface, can differ in width from flat region(s) on the other surface of the plate, such as the second surface. By way of example, if a preferred or desired height of a side wall is less than about one inch, such as about ⅞ inch, and the diameter of the plate is about 9½ inches, a flat region of about one inch in width can be introduced at the top of the slope and at the bottom of the slope on a surface of the plate. Alternatively, the width of the flat region at the top of the slope can differ from the width of the flat region at the bottom of the slope. For example, the flat region at the top of the slope can be about one inch, whereas the flat region at the bottom of the slope can be about ¾ inch, about ½ inch, or about ¼ inch. In this regard, if the flat region at the top of the slope on the first surface of the plate is about one inch and the flat region at the bottom of the slope on the first surface of the plate is about ¼ inch, then the flat region at the top of the slope on the second surface of the plate can be about ¼ inch and the flat region at the bottom of the slope on the second surface of the plate can be about one inch.

Thus, in view of the above, a method of making a reversible food plate is provided. The method comprises:

(i) molding from plastic, such as a flexible plastic, a food plate comprising a first surface and a second surface, each of which has a slope, and an edge, wherein the slope of the first surface optionally comprises at least one depression at the bottom of the slope and adjacent to the edge, and wherein (i) at least each portion of the edge that is adjacent to the bottom of the slope is formed into a first rim or (ii) substantially all or all of the edge is formed into a first rim and at least each portion of the first rim that is adjacent to the bottom of the slope is pronounced or more pronounced than a portion of the first rim that is not adjacent to the bottom of the slope, and the first rim of the first surface can be stably placed on a flat or substantially flat surface with the outer edge or edges of the first rim substantially parallel to the flat or substantially flat surface, wherein the slope of the second surface optionally comprises at least one depression at the bottom of the slope and adjacent to the edge, and wherein (i) at least each portion of the edge that is adjacent to the bottom of the slope is formed into a second rim or (ii) substantially all or all of the edge is formed into a second rim and at least each portion of the second rim that is adjacent to the bottom of the slope is pronounced or more pronounced than a portion of the second rim that is not adjacent to the bottom of the slope, and the second rim of the second surface can be stably placed on a flat or substantially flat surface with the outer edge or edges of the second rim substantially parallel or parallel to the flat or substantially flat surface, wherein the bottom of the slope of the first surface is on the opposite end of the plate from the bottom of the slope of the second surface, and wherein the first rim and the second rim form a side wall having an external surface and, when the first rim of the first surface or the second rim of the second surface is placed on a flat or substantially flat surface, the external surface of the side wall is perpendicular to the flat or substantially flat surface, and (ii) simultaneously or subsequently over-molding the side wall, such as over-molding the side wall with a TPE. The plastic can be flexible, in which case, when the food plate is placed on a flat or substantially flat surface with the first surface or the second surface facing upwardly and pressure is applied on the upwardly facing surface, suction is created between the side wall of the food plate and the flat or substantially flat surface. The plastic can be a thermoplastic polymer, such as polypropylene. The first rim of the plate can be tapered slightly at the edge so that it fits inside the second rim of a reversible food plate stacked on top of it or the second rim of the plate can be tapered slightly at the edge so that it fits inside the first rim of a reversible food plate stacked on top of it. The first surface, the second surface, or the first surface and the second surface can further comprise a surface wall, which, together with the side wall of the plate, can enclose an area at the base of the slope. The slope of the first surface, the slope of the second surface, or the slope of the first surface and the slope of the second surface can comprise a depression, in which case the surface wall, together with the side wall of the plate, can enclose the depression. A flat region can be introduced at the top and/or the bottom of a slope on one or both sides of a plate, depending on the method of manufacture, such as molding (e.g., injection molding), in an effort, for example, to obtain a side wall of a preferred or desired height. A flat region can be introduced at the top of the slope, at the bottom of the slope, or at the top of the slope and at the bottom of the slope, wherein the flat region or flat regions can be present on one surface of the plate, such as the first surface or the second surface, or on both surfaces of the plate, i.e., the first surface and the second surface.

An adapter for a conventional food plate is also provided. The adapter comprises a graduated (i.e., difference in height from one side of the adapter to the other), optionally flexible, rim, which, upon attachment to the food plate, causes the food-bearing side of the food plate to have a slope. Desirably, the degree of the slope is sufficient to allow a liquid to move down the slope. Preferably, the degree of the slope is sufficient to allow a viscous liquid, such as syrup, to move down the slope. The degree of the slope should not be so great as to make eating off the food plate difficult. Preferably, the slope is less than about 15°, such as about 2.5°, about 5°, about 7.5°, about 10°, or about 12.5°. The graduated rim optionally comprises, and preferably does comprise, an interior groove or interior ledge, which can be continuous or intermittent, into/onto which the edge of the conventional food plate can be placed. Preferably, the graduated rim is flexible. The adapter can further comprise an adjoining depression, which, upon attachment of the adapter to the food plate, results in the depression being positioned at the bottom of the slope. The adjoining depression is optionally removable from the graduated rim or the conventional food plate at the bottom of the slope.

Figure 5:
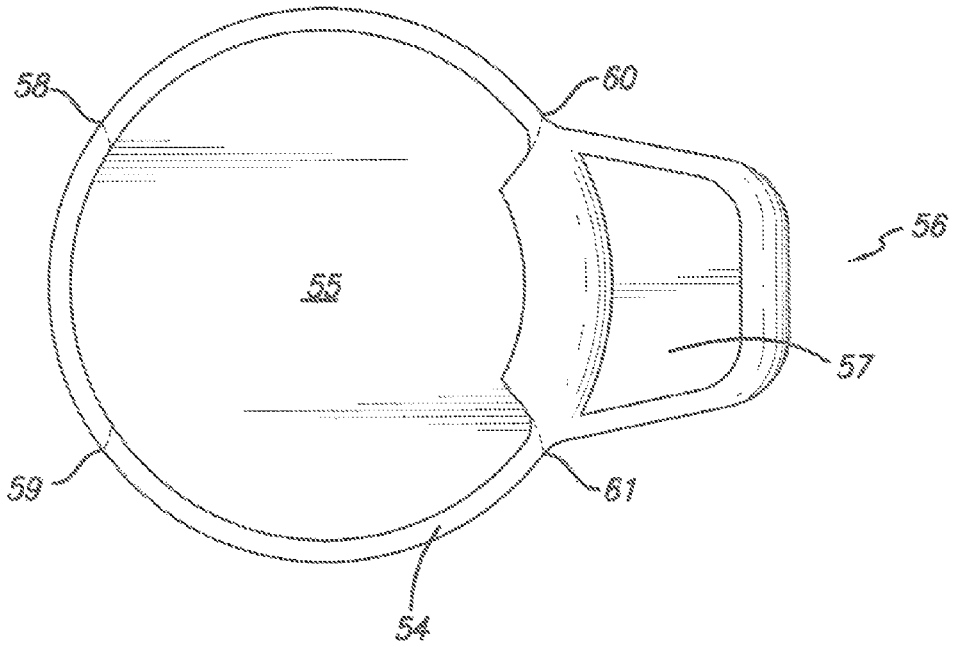
FIG. 5 is a top view of a conventional food plate (55) with an adapter (56) attached. The adapter in this figure comprises a graduated, optionally flexible, rim (54) and an optionally present adjoining depression (57). The dotted lines 58-61 show an alternate embodiment of the adapter, in which the region between dotted lines 58 and 59 represents a first part of the graduated rim (54), and the region between dotted lines 60 and 61 represents a second part of the graduated rim (54). In this alternate embodiment of the adapter the edge of the conventional food plate between dotted lines 58 and 60 and dotted lines 59 and 61, respectively, is exposed.
Figure 6:
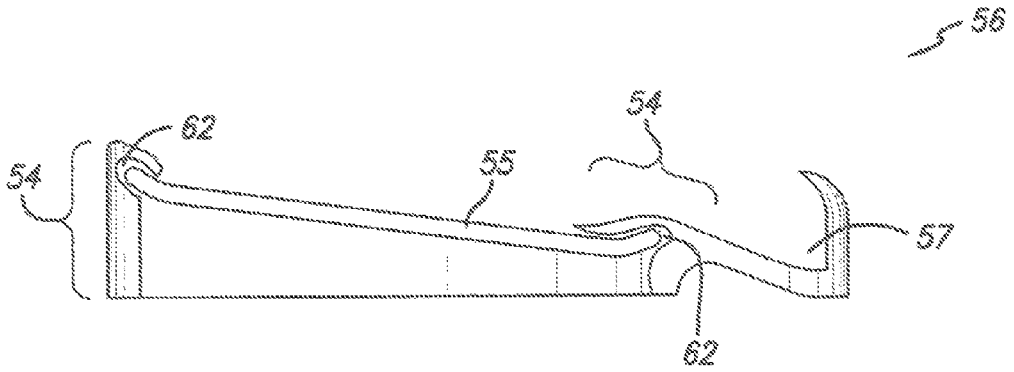
FIG. 6 is a cross-sectional view of the conventional food plate (55) with an adapter (56) having an optionally present adjoining depression (57) attached as shown in FIG. 5. In this cross-section, an interior groove (62), which is optionally present in the graduated rim (54) of the adapter (56), is shown.

An example of an adapter with an adjoining depression is shown in FIGS. 5 and 6. FIG. 5 is a top view and FIG. 6 is a cross-sectional view of a conventional food plate (55) with an adapter (56) attached. The adapter in these figures comprises a graduated rim (54) and an optionally present adjoining depression (57), which can be optionally removable. In other words, the adjoining depression (57) can be part of the graduated rim (54) or separate. If separate, preferably it is adapted for removable attachment to the graduated rim (54) or the conventional food plate at the bottom of the slope created by the adapter. The dotted lines 58-61 show an alternate embodiment of the adapter, in which the region between dotted lines 58 and 59 represents a first part, and the region between dotted lines 60 and 61 represents a second part. In this alternate embodiment of the adapter the edge of the conventional food plate between dotted lines 58 and 60 and dotted lines 59 and 61, respectively, is exposed. The cross-sectional view in FIG. 6 shows an interior groove (62; which alternatively can be an interior ledge), which is optionally present in the adapter. In other words, it can be possible to use an adapter comprising a graduated rim that does not comprise an interior groove or an interior ledge. However, preferably, the adapter comprises a graduated rim comprising an interior groove (into which the edge of the conventional plate can be placed) or an interior ledge (onto which the edge of the conventional plate can be placed). An interior groove or interior ledge, which can be continuous or intermittent, can help to stabilize the plate during use. Preferably, the graduated rim is flexible.

Figure 7:
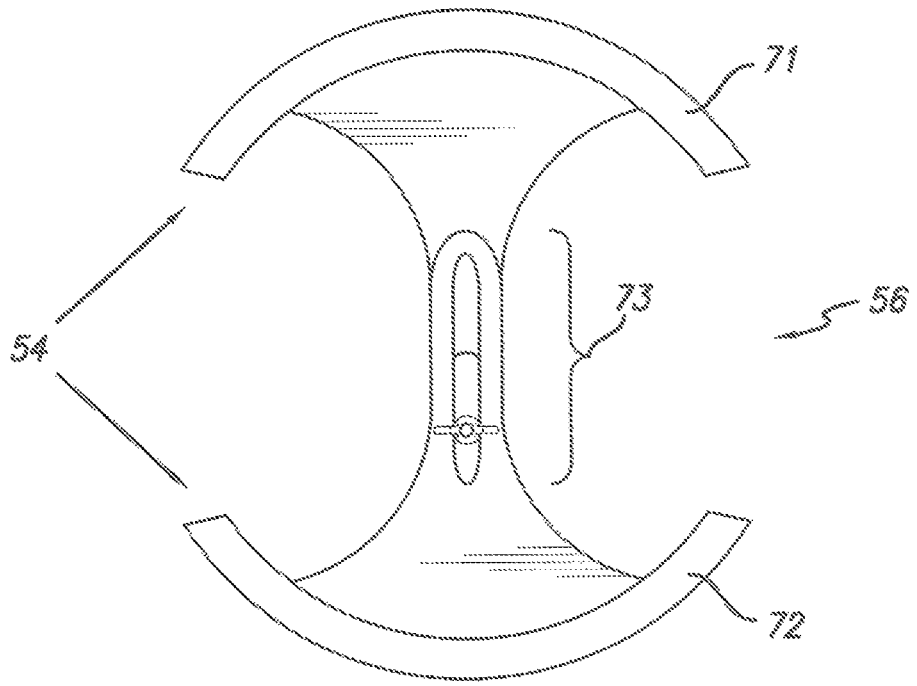
FIG. 7 is a top view of an alternate embodiment of an adapter (56). The flexible rim (54) comprises a first part (71) and a second part (72). In this top view, the adapter comprises an example of an adjuster (73), which adjusts the distance between the first part (71) and the second part (72).
Figure 8:
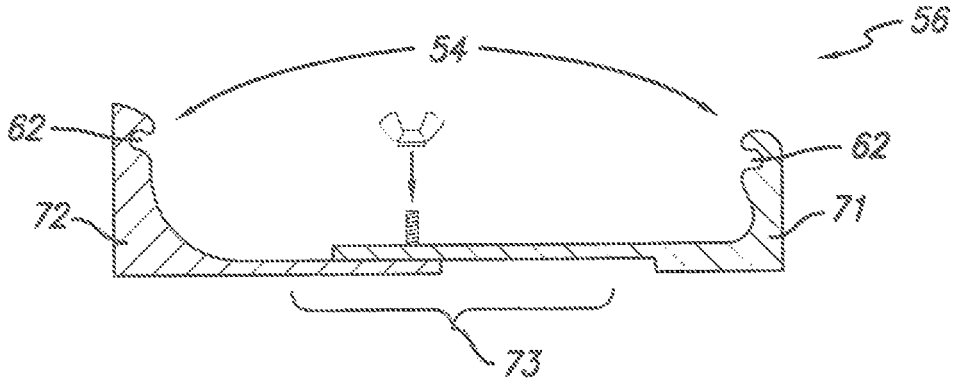
FIG. 8 is a cross-sectional view of the adapter (56) shown in FIG. 7.
Figure 10:
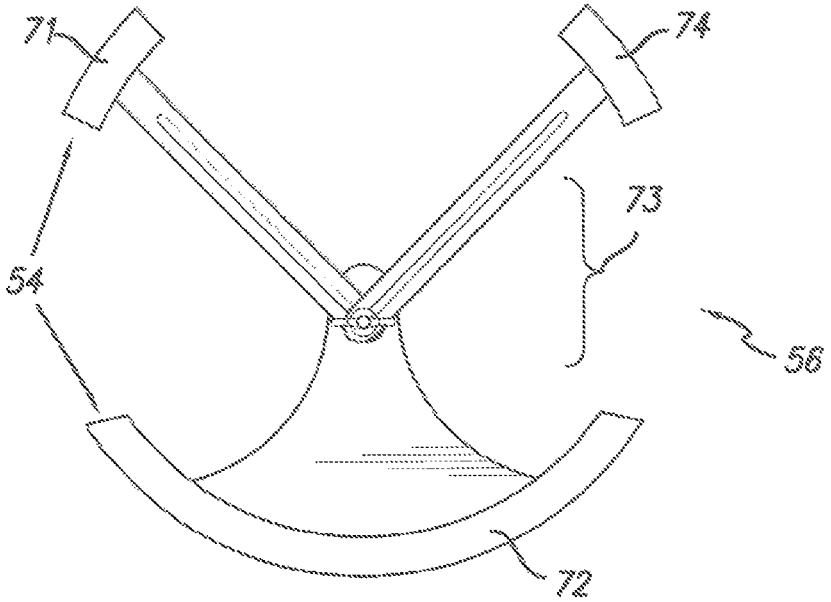
FIG. 10 is a top view of an alternate embodiment of an adapter (56). The flexible rim (54) comprises a first part (71), a second part (72), and a third part (74). In this top view, the adapter comprises an example of an adjuster (73), which adjusts the distance between the first part (71), the second part (72), and the third part (74).
Figure 11:
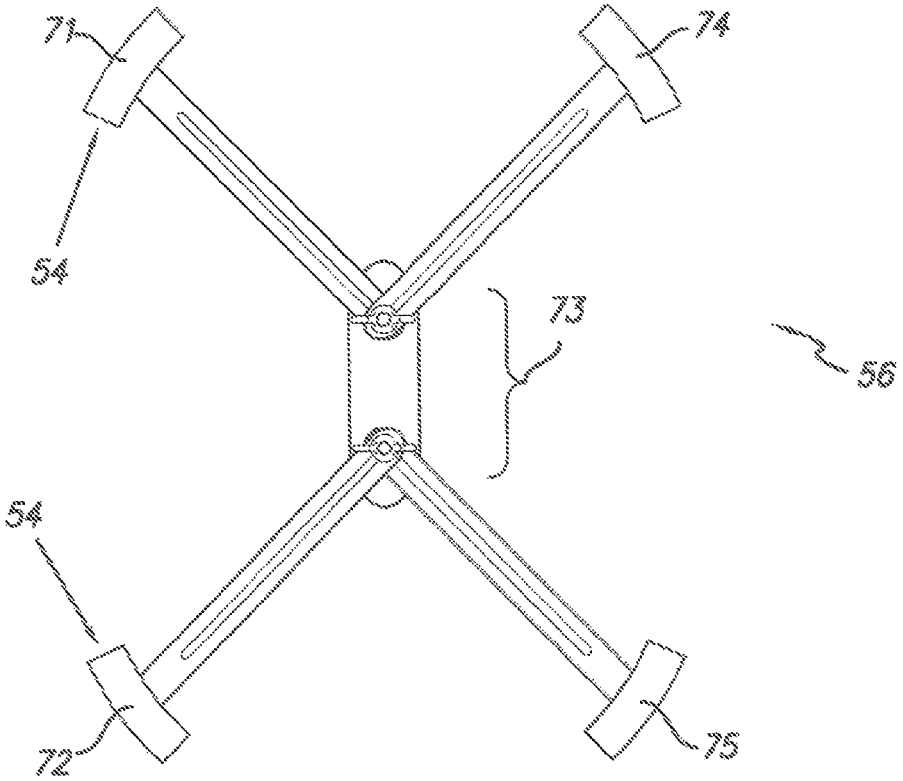
FIG. 11 is a top view of an alternate embodiment of an adapter (56). The flexible rim (54) comprises a first part (71), a second part (72), a third part (74), and a fourth part (75). In this top view, the adapter comprises an example of an adjuster (73), which adjusts the distance between the first part (71), the second part (72), the third part (74), and the fourth part (75).

In an alternate embodiment of an adapter, the graduated rim can comprise at least a first part and a second part (such as a first part, a second part, a third part, and a fourth part). An example of an alternate embodiment of an adapter is shown in FIGS. 7 and 8. FIG. 7 is a top view and FIG. 8 is a cross-sectional view of an alternate embodiment of an adapter (56). In these figures, the graduated rim (54) comprises a first part (71) and a second part (72). When the adapter comprises at least a first part and a second part, the rim need not be flexible; however, flexibility can aid positioning of the adapter onto a food plate, such as a conventional food plate. In the top view shown in FIG. 7, the adapter comprises an example of an adjuster (73), which adjusts the distance between the first part (71) and the second part (72). Adjusting the distance between the first part (71) and the second part (72) (or the distances between the first part, the second part, the third part and the fourth part) positions the adapter onto the food plate. Another example of an alternate embodiment of an adapter is shown in FIG. 10, which is a top view of an alternate embodiment of an adapter (56). The flexible rim (54) comprises a first part (71), a second part (72), and a third part (74). In this top view, the adapter comprises an example of an adjuster (73), which adjusts the distance between the first part (71), the second part (72), and the third part (74). Yet another example of an alternate embodiment of an adapter is shown in FIG. 11, which is a top view of an alternate embodiment of an adapter (56). The flexible rim (54) comprises a first part (71), a second part (72), a third part (74), and a fourth part (75). In this top view, the adapter comprises an example of an adjuster (73), which adjusts the distance between the first part (71), the second part (72), the third part (74), and the fourth part (75). While not shown in FIGS. 7, 8, 10 and 11, the parts, such as the first part (71) and the second part (72), the first part (71), the second part (72) and the third part (74), or the first part (71), the second part (72), the third part (74) and the fourth part (75), as the case may be, can comprise height adjusters, which can be used to adjust the slope of the food plate. In this regard, if an adjuster comprises two parts, the first part (71) or the second part (72) can comprise a height adjuster. If an adjuster comprises three parts, either (i) the first part (71) and the third part (74) or (ii) the second part (72), for example, can comprise a height adjuster. If an adjuster comprises four parts, either (i) the first part (71) and the third part (74) or (ii) the second part (72) and the fourth part (75), for example, can comprise a height adjuster.

Figure 12:
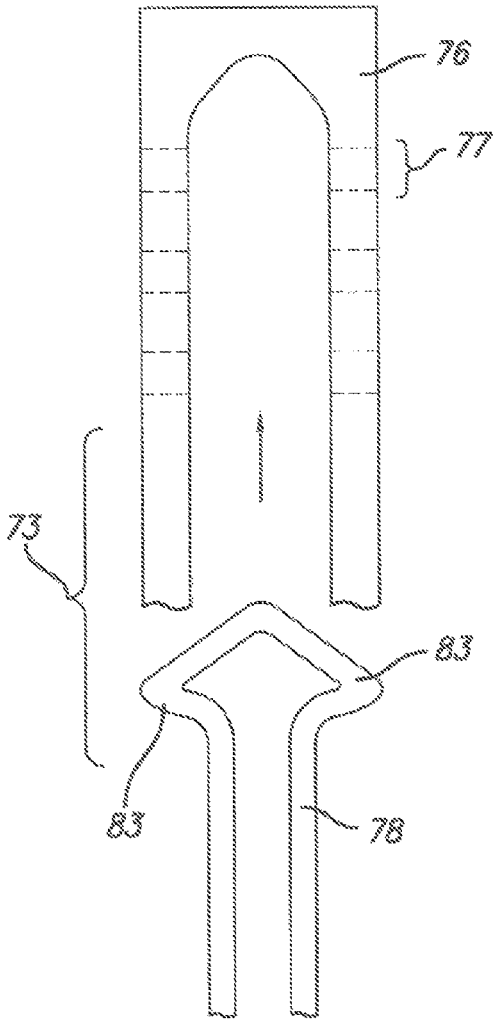
FIG. 12. is an exploded partial top view of an alternate embodiment of an adjuster (73). In this embodiment, a first part (78), which can be squeezed and released, is inserted into a second part (76), which comprises internal transverse channels (77) into which the side projections (83) on the first part (78) can be placed.
Figure 13:
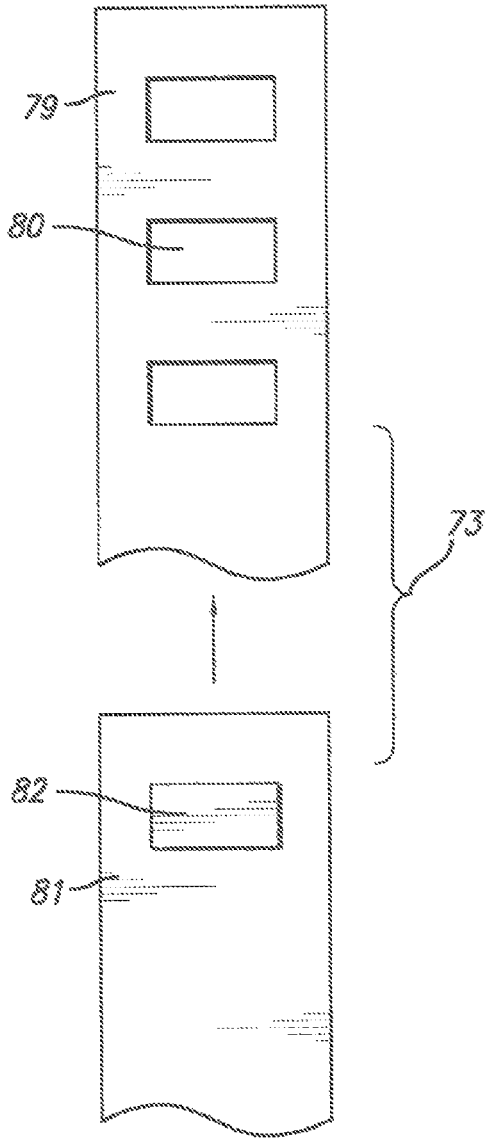
FIG. 13 is an exploded partial top view of an alternate embodiment of an adjuster (73). In this embodiment, a first part (81) comprises a top projection (82), which is inserted into an opening (80) on a second part (79).

Any suitable type of adjusters can be used. See, e.g., the adjuster (73) in FIGS. 7, 8, 10, and 11. Other examples of adjusters, which are not intended to be limiting, are shown in FIGS. 12 and 13. FIG. 12. is an exploded partial top view of an alternate embodiment of an adjuster (73). In this embodiment, a first part (78), which can be squeezed and released, is inserted into a second part (76), which comprises internal transverse channels (77) into which the side projections (83) on the first part (78) can be placed. FIG. 13 is an exploded partial top view of an alternate embodiment of an adjuster (73). In this embodiment, a first part (81) comprises a top projection (82), which is inserted into an opening (80) on a second part (79). Preferably, the adjusters can be easily adjusted, irrespective of whether the plate is already positioned between the parts or not.

The adapter can further comprise a removable lid. Optionally, eating utensils, such as those described above, can be removably attached to the lid.

In view of the foregoing, a method of making an adapter for a conventional food plate is provided. The method comprises forming a graduated, optionally flexible, rim, which optionally comprises at least a first part and a second part and which, upon attachment to the conventional food plate, causes the food-bearing side of the food plate to have a slope, and, optionally, introducing an interior groove or interior ledge into the graduated rim into/onto which the edge of the conventional food plate can be placed. Preferably, the method comprises introducing the interior groove or interior ledge, which can be continuous or intermittent, into the graduated rim. The graduated rim can further comprise an adjoining depression, which, upon attachment of the adapter to the conventional food plate, results in the depression being positioned at the bottom of the slope. If the graduated rim further comprises an adjoining depression, the adjoining depression can be part of the graduated rim or adapted for removable attachment to the graduated rim or the food plate at the bottom of the slope. The method can further comprise introducing an adjuster between at least the first part and the second part.

EXAMPLES

The following examples serve to illustrate the present disclosure and are not intended to limit the scope of the claimed invention in any way.

Example 1

This example describes the manufacture of a reversible, sloping plate with an over-molded side wall.

A reversible, sloping plate having a first surface and a second surface was molded from polypropylene. The plate had an edge, which formed a first rim on the first surface and a second rim on the second surface. Each surface had a slope, and the bottom of the slope of the first surface was on the opposite end of the plate from the bottom of the slope of the second surface. The first rim and the second rim formed a side wall having an external surface and, when the first rim of the first surface or the second rim of the second surface was placed on a flat or substantially flat surface, the external surface of the side wall was perpendicular to the flat or substantially flat surface. The side wall of the plate was over-molded with thermoplastic elastomer (TPE); in this case, Monprene® from Teknor Apex (Pawtucket, R.I.). Material melt and processing were performed at about 400° F., with the propylene injection-molded in about 40 seconds and the TPE overmold injection-molded in less than about a minute. The over-molding of the side wall of the plate provided a gripping surface and inhibited skidding of the plate on a smooth, flat surface.

Example 2

This example describes the creation and elimination of suction between a reversible, sloping plate with an over-molded side wall and a flat surface.

A woman, a man, and their daughter, who is 13 years old, separately placed the plate on various flat surfaces. The flat surfaces included glass, marble, granite, and tile. On each surface, the person pressed down on the top surface of the plate. When pressure was applied to the top surface of the plate by the person, suction was created between the plate and the flat surface. Each person made repeated attempts to create suction between the plate and the flat surface. Every attempt on each of the flat surfaces was successful; however, it was observed that pressing down on the center of the top surface of the plate created more suction than pressing down elsewhere on the top surface of the plate and that applying more pressure to the center of the top surface of the plate also increased the strength of the suction. In addition, it was observed that lifting up on the side wall of the plate while pressing down on the center of the top surface of the plate released the suction between the plate and the flat surface.

All patents, patent application publications, journal articles, textbooks, and other publications mentioned in the specification are indicative of the level of skill of those in the art to which the disclosure pertains. All such publications are incorporated herein by reference to the same extent as if each individual publication were specifically and individually indicated to be incorporated by reference.

The invention illustratively described herein may be suitably practiced in the absence of any element(s) or limitation(s), which is/are not specifically disclosed herein. Thus, for example, each instance herein of any of the terms "comprising," "consisting essentially of," and "consisting of" may be replaced with either of the other two terms. Likewise, the singular forms "a," "an," and "the" include plural references unless the context clearly dictates otherwise. Thus, for example, references to "the method" includes one or more methods and/or steps of the type, which are described herein and/or which will become apparent to those ordinarily skilled in the art upon reading the disclosure.

The terms and expressions, which have been employed, are used as terms of description and not of limitation. There also is no intention in the use of such terms and expressions of excluding any equivalents of the features shown and described or portions thereof.

It is recognized that various modifications are possible within the scope of the claimed invention. Thus, it should be understood that, although the present invention has been specifically disclosed in the context of preferred embodiments and optional features, those skilled in the art may resort to modifications and variations of the concepts disclosed herein. Such modifications and variations are considered to be within the scope of the invention as defined by the appended claims.

What is claimed is:

1. A reversible food plate comprising:

a first surface and a second surface, each of which has a slope, and an edge, wherein the slope of the first surface optionally comprises at least one depression at the bottom of the slope and adjacent to the edge, and wherein (i) at least each portion of the edge that is adjacent to the bottom of the slope forms a first rim or (ii) substantially all or all of the edge forms a first rim and at least each portion of the first rim that is adjacent to the bottom of the slope is pronounced or more pronounced than a portion of the first rim that is not adjacent to the bottom of the slope, wherein the slope of the second surface optionally comprises at least one depression at the bottom of the slope and adjacent to the edge, and wherein (i) at least each portion of the edge that is adjacent to the bottom of the slope forms a second rim or (ii) substantially all or all of the edge forms a second rim and at least each portion of the second rim that is adjacent to the bottom of the slope is pronounced or more pronounced than a portion of the second rim that is not adjacent to the bottom of the slope, wherein the bottom of the slope of the first surface is on the opposite end of the plate from the bottom of the slope of the second surface, wherein the first rim and the second rim form a side wall having an external surface and, when the first rim of the first surface or the second rim of the second surface is placed on a flat or substantially flat surface, the external surface of the side wall is perpendicular to the flat or substantially flat surface, and wherein the food plate is molded from plastic and the side wall is over-molded with a thermoplastic elastomer (TPE).

2. The reversible food plate of claim 1, which further comprises at least one removable lid to which is optionally removably attached one or more eating utensils.

3. The reversible food plate of claim 1, which further comprises a surface wall, which, together with the side wall of the plate, enclose an area at the base of the slope.

4. The reversible food plate of claim 1, which comprises a flat region at the top of the slope, at the bottom of the slope, or at the top of the slope and at the bottom of the slope of the first surface and/or a flat region at the top of the slope, at the bottom of the slope, or at the top of the slope and at the bottom of the slope of the second surface.

5. The reversible food plate of claim 1, wherein the slope of the first surface comprises one depression.

6. The reversible food plate of claim 5, which further comprises a surface wall, which, together with the side wall of the plate, enclose the depression.

7. The reversible food plate of claim 1, which is stackable.

8. The reversible food plate of claim 7, wherein the first rim is tapered slightly at the edge so that it fits inside the second rim of a reversible food plate stacked on top of it or wherein the second rim is tapered slightly at the edge so that it fits inside the first rim of a reversible food plate stacked on top of it.

9. The reversible food plate of claim 1, wherein the slope of the second surface comprises one depression.

10. The reversible food plate of claim 9, which further comprises a surface wall, which, together with the side wall of the plate, enclose the depression.

11. The reversible food plate of claim 1, wherein the plastic is flexible, in which case, when the food plate is placed on a flat or substantially flat surface with either the first surface or the second surface facing upwardly and pressure is applied on the upwardly facing surface, suction is created between the side wall of the food plate and the flat or substantially flat surface.

12. The reversible food plate of claim 11, wherein the plastic is a thermoplastic polymer.

13. The reversible food plate of claim 12, wherein the thermoplastic polymer is polypropylene.

14. A method of making a reversible food plate, which method comprises:

(i) molding from plastic a food plate comprising a first surface and a second surface, each of which has a slope, and an edge, wherein the slope of the first surface optionally comprises at least one depression at the bottom of the slope and adjacent to the edge, and wherein (i) at least each portion of the edge that is adjacent to the bottom of the slope is formed into a first rim or (ii) substantially all or all of the edge is formed into a first rim and at least each portion of the first rim that is adjacent to the bottom of the slope is pronounced or more pronounced than a portion of the first rim that is not adjacent to the bottom of the slope, and the first rim of the first surface can be stably placed on a flat or substantially flat surface with the outer edge or edges of the first rim substantially parallel to the flat or substantially flat surface, wherein the slope of the second surface optionally comprises at least one depression at the bottom of the slope and adjacent to the edge, and wherein (i) at least each portion of the edge that is adjacent to the bottom of the slope is formed into a second rim or (ii) substantially all or all of the edge is formed into a second rim and at least each portion of the second rim that is adjacent to the bottom of the slope is pronounced or more pronounced than a portion of the second rim that is not adjacent to the bottom of the slope, and the second rim of the second surface can be stably placed on a flat or substantially flat surface with the outer edge or edges of the second rim substantially parallel or parallel to the flat or substantially flat surface, wherein the bottom of the slope of the first surface is on the opposite end of the plate from the bottom of the slope of the second surface, and wherein the first rim and the second rim form a side wall having an external surface and, when the first rim of the first surface or the second rim of the second surface is placed on a flat or substantially flat surface, the external surface of the side wall is perpendicular to the flat or substantially flat surface, and (ii) simultaneously or subsequently over-molding the side wall with a thermoplastic elastomer (TPE), whereupon the food plate comprising a first surface and a second surface, each of which has a slope, and an edge is made.

15. The method of claim 14, wherein the first rim of the plate is tapered slightly at the edge so that it fits inside the second rim of a reversible food plate stacked on top of it or wherein the second rim of the plate is tapered slightly at the edge so that it fits inside the first rim of a reversible food plate stacked on top of it.

16. The method of claim 14, wherein the first surface, the second surface, or the first surface and the second surface further comprise(s) a flat region at the top of the slope, a flat region at the bottom of the slope, or a flat region at the top of the slope and a flat region at the bottom of the slope.

17. The method of claim 14, wherein the first surface, the second surface, or the first surface and the second surface further comprise(s) a surface wall, which, together with the side wall of the plate, enclose an area at the base of the slope.

18. The method of claim 17, wherein the slope of the first surface, the slope of the second surface, or the slope of the first surface and the slope of the second surface comprise a depression, in which case the surface wall, together with the side wall of the plate, enclose the depression.

19. The method of claim 14, wherein the plastic is flexible, in which case, when the food plate is placed on a flat or substantially flat surface with either the first surface or the second surface facing upwardly and pressure is applied on the upwardly facing surface, suction is created between the side wall of the food plate and the flat or substantially flat surface.

20. The method of claim 19, wherein the plastic is a thermoplastic polymer.

21. The method of claim 20, wherein the thermoplastic polymer is polypropylene.

* * * * *